United States Patent [19]

Dick et al.

[11] 4,236,842

[45] Dec. 2, 1980

[54] HAMMER SUPPORT FOR ROTARY PRINTING APPARATUS

[75] Inventors: George H. Dick, Highland Park; John A. Smith, Round Lake Beach, both of Ill.

[73] Assignee: A. B. Dick Company, Chicago, Ill.

[21] Appl. No.: 930,809

[22] Filed: Aug. 3, 1978

[51] Int. Cl.[3] ..... B41J 3/10

[52] U.S. Cl. ..... 400/144.2; 400/144.3; 101/93.48; 335/274

[58] Field of Search ..... 101/93.29, 93.34, 93.48, 101/93.02; 400/144.2, 144.3, 157.2, 167; 335/261, 262, 270, 274, 255, 278

[56] References Cited

U.S. PATENT DOCUMENTS

| | | | |
|---|---|---|---|
| 2,632,791 | 3/1953 | Side | 335/270 X |
| 2,882,461 | 4/1959 | Glassow | 335/270 |
| 3,072,045 | 1/1963 | Goin | 101/93.29 |
| 3,162,285 | 12/1964 | Sala | 335/270 X |
| 3,335,659 | 8/1967 | Schacht et al. | 101/93.02 |
| 3,351,006 | 11/1967 | Belson | 101/93.02 |
| 3,356,199 | 12/1967 | Robinson | 101/93.29 X |
| 3,459,126 | 8/1969 | Nyman | 101/93.29 |
| 3,831,729 | 8/1974 | Howard | 335/274 X |
| 3,834,304 | 9/1974 | Potto | 400/124 X |

*Primary Examiner*—Edward M. Coven

*Attorney, Agent, or Firm*—McDougall, Hersh & Scott

[57] ABSTRACT

A printing apparatus which includes a support for paper and a plurality of printing dies for making impressions on the paper. A reciprocally driven hammer is employed for causing the dies to form the impressions, and the hammer is supported by spring arms which are, in turn, attached to a fixture. This fixture includes an opening freely receiving the hammer whereby the hammer is movable without contact with the fixture. A portion of each spring arm is attached to the hammer at forward and rearward locations, and other portions extend outwardly of the hammer axis whereby the hammer is stabilized at all times. The spring action normally biases the hammer away from the dies, and drive force is imparted in opposition to the spring force as by an electrical coil attached to the hammer and situated within a magnetic field.

6 Claims, 8 Drawing Figures

HAMMER SUPPORT FOR ROTARY PRINTING APPARATUS

BACKGROUND OF THE INVENTION

This invention relates to a printing apparatus. The invention has particular application to high speed printers wherein impression dies are positioned adjacent paper for the formation of impressions on the paper. In a typical situation, a ribbon is employed whereby a visible impression is achieved.

In order to provide maximum operating speed, reciprocating hammers are employed as the means for supplying the force to achieve a suitable impression. The hammer may be supported on a carriage along with a ribbon, and the carriage is driven adjacent a platen or the like which supports a sheet of paper. In a system such as described in Martin, et al. U.S. Pat. No. 4,030,591, the impression dies are positioned at the end of spokes of a rotatable printing disc. This disc is also supported on the carriage, and the operating sequence involves shifting of the carriage from one position to the next and simultaneous shifting of the disc to locate the next desired die opposite the hammer. The hammer is then driven into engagement with the spoke supporting the die whereby the die will engage the adjacent ribbon which, in turn, forms the impression on the paper. The sequence is then repeated wherein the carriage and disc shift to the next position, and the hammer again operates.

In one alternative arrangement such as described in Goin U.S. Pat. No. 3,072,045, the impression dies are formed on a wheel, and paper and ribbon are moved adjacent the wheel. The hammer is located on the side of the paper opposite the wheel.

Although very high operating speeds can be achieved with systems of the type referred to, certain problems are recognized. Specifically, the necessity for continuously driving the hammer at high speed and with suitable force creates conditions leading to significant wear. The life of parts can thus be relatively short necessitating undesirably frequent equipment maintenance.

The wear problem also particularly effects the quality of printing achieved. In order to provide suitable quality, it is necessary that the hammer strike at a precise position since otherwise the printed character will not have a consistent appearance. For example, in the case of a printer utilizing a rotating disc, it is necessary that the hammer engage the spokes with precision in order to provide uniform engagement of the dies with the ribbon and paper. If the hammer strikes a spoke at an angle, the spoke and the associated die would be tilted so that one portion of the die would engage the ribbon and paper with different force than another portion thereby resulting in uneven character appearance.

It has also been recognized, for example as described in Helms U.S. Pat. No. 3,172,353, that the energy imparted to a hammer die significantly affects the appearance of printed material. Specifically, if a single energy level is imparted, the surface area of the character involved will determine the appearance of the printed character. A "." or a "," thus has a significantly smaller surface area than an "M" or "W". The same force applied by the hammer would thus result in a lighter print for the "M" or "W" if a low energy level is involved. On the other hand, if a high energy level is involved in order to achieve sufficient force for the "M" or "W", then there is a significant possibility that the "." or "," die will penetrate the paper.

Different energy levels have been proposed, for example in structures utilizing solenoid driven hammers. Thus, two or more levels of power are made available with the particular connections to the solenoid depending upon the particular character to be printed. The aforementioned Goin patent also addresses this problem by utilizing a coil movable in a magnetic field. The energy imparted to a hammer connected to the coil is controlled by varying the current supplied to the coil.

Helms U.S. Pat. Nos. 3,172,352 and 3,172,353 also discuss the use of coils attached to a hammer and situated within a magnetic field to provide driving force. In these cases, the hammer is mounted on flexible rod-like supports while in Goin, the hammer is attached to a diaphragm or deformable disc.

Although addressing the problem to a degree, the prior at has not developed a completely suitable combination which avoids the aforementioned wear and alignment problems while also permitting significant selectivity from the standpoint of energy imparted to a reciprocating hammer.

SUMMARY OF THE INVENTION

This invention is directed to printing apparatus of the type described wherein paper is positioned adjacent movable printing dies, and a hammer is employed for providing the force necessary for achieving impressions on the paper. The invention is more specifically directed to a structure for supporting the hammer, and the associated drive means whereby problems recognized in prior systems are avoided.

The apparatus of this invention includes a fixture which defines an opening for freely receiving a reciprocating hammer. Spring arm means are employed for attaching the hammer to the fixture, and the hammer otherwise moves without contact with the fixture. The spring arm means preferably comprise a pair of integral springs positioned on the fixture in spaced relationship. Each spring includes a central arm having the hammer attached thereto. A pair of outer arms are provided for each spring, and these outer arms are connected to the fixture. When at rest, the springs normally bias the hammer away from the associated printing dies.

A suitable drive means, preferably a moving coil arrangement, is associated with the hammer. Particularly, the engaging portion of the hammer is located at one end of a shaft with a moving coil attached at the other end of the shaft. A magnetic field is provided, and when current is supplied to the coil, it moves thereby driving the hammer. In the hammer force applying section of the cycle, the drive action of the coil is in opposition to the spring action. The spring action may be relied on for return movement of the hammer or reverse current may be applied for accelerating the return movement. In addition, a current pulse may be employed for braking the coil at the end of the return movement.

The utilization of spring arms in association with a fixture as described provides an arrangement which is extremely reliable from the standpoint of alignment of the hammer with impression dies. Furthermore, the arrangement is not subject to any significant wear since there is no significant contact between moving parts. The spring arm arrangement is particularly characterized by an extremely long operating life, and the arrangement is highly suitable from the standpoint of the degree of allowable movement of a hammer.

DESCRIPTION OF THE PREFERRED EMBODIMENT

Figure 1:
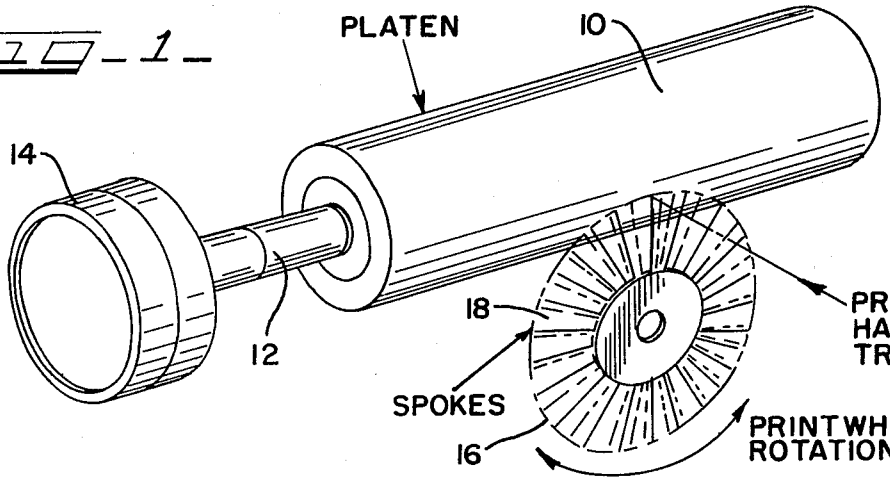
FIG. 1 is a fragmentary, perspective view illustrating a printing arrangement of a type suitable for use in conjunction with the apparatus of this invention.

FIG. 1 illustrates typical elements associated with a rotary printer. These include platen 10 mounted on shaft 12 with a drive 14 connected to the shaft whereby manual or automatic rotation of the shaft can be accomplished. A rotatably mounted printing disc 16 is positioned adjacent the platen surface. Individual spokes 18 are provided on the disc, and printing dies are located on these spokes. These dies will typically support characters of the type normally found on a typewriter.

Figure 2:
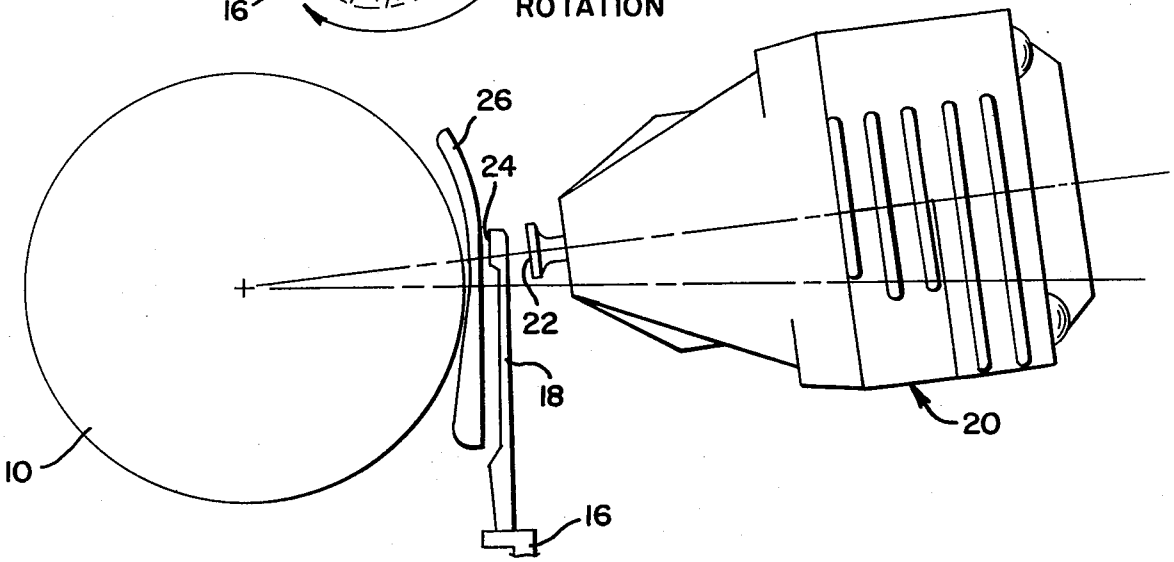
FIG. 2 is a side view of a hammer support structure in position relative to a platen and rotary printing disc.

As shown in FIG. 2, a hammer supporting mechanism 20 is positioned adjacent the platen 10. The hammer includes an engaging end 22, and the die supporting ends 24 of spokes 18 are each adapted to be positioned between the hammer end 22 and the platen surface. A paper or card guide 26 may be utilized in appropriate circumstances for assisting in maintaining material to be printed on the platen surface. Also in accordance with standard practice, a ribbon will be interposed between the spoke end 24 and the platen.

The assembly of the hammer support printing wheel and ribbon cartridge will typically be mounted on a carriage for movement along the length of the platen 10. A motor for the printing wheel may be actuated through either manually or automatically operated controls whereby the printing wheel will move an appropriate spoke into position during each shifting movement of the carriage. Driving of the hammer will then force the die on the selected spoke against the ribbon and paper to achieve the desired impressions. It will be understood that the control means for initiating the printing wheel and hammer drive may be of any conventional design. It will also be appreciated that the hammer support and associated drive to be described hereinafter may be utilized in conjunction with types of printing machines other than the rotating printing wheel type illustrated.

FIGS. 3 through 6 illustrate the hammer support structure 20. This structure comprises a housing including the enclosure 28 positioned on the forward side. This enclosure defines an opening 30 through which the engaging end 22 of the hammer extends. A rearward portion of the housing consists of section 32 having an end cap 34 of magnetic material attached thereto.

An outer ring of magnetic material 38 is positioned within section 32. Fasteners 36 extend through the end cap 34 and into engagement with threaded bores 40 in section 32 to hold the parts in assembly. These bores are in alignment with bores in enclosure 28 whereby this enclosure is also secured in the assembly.

Figure 6:
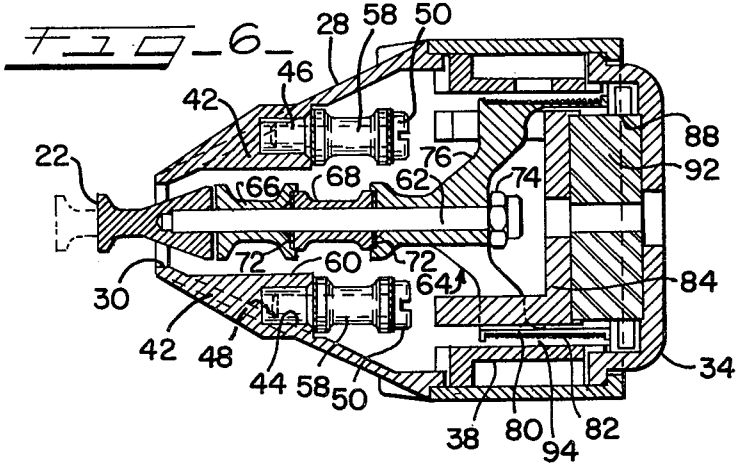
FIG. 6 is a cross-sectional view of the support structure taken about the line 6—6 of FIG. 4.

As shown in FIG. 6, the enclosure 28 includes molded interior sections 42 which define bores 44 having cylindrical threaded inserts 46 press-fit therein. These inserts define threaded bores 48 for receiving the ends of threaded fasteners 50.

Figure 8:
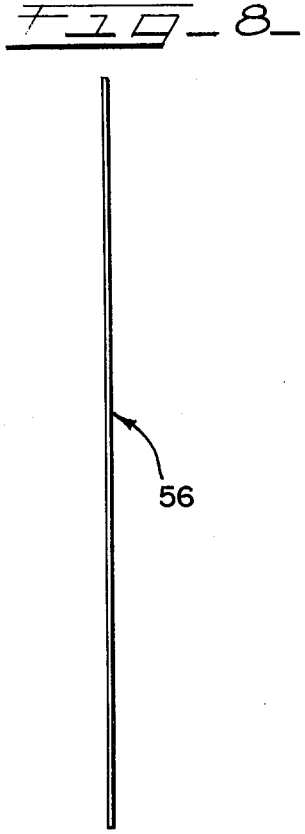
FIG. 8 is a side view of the spring.
Figure 7:
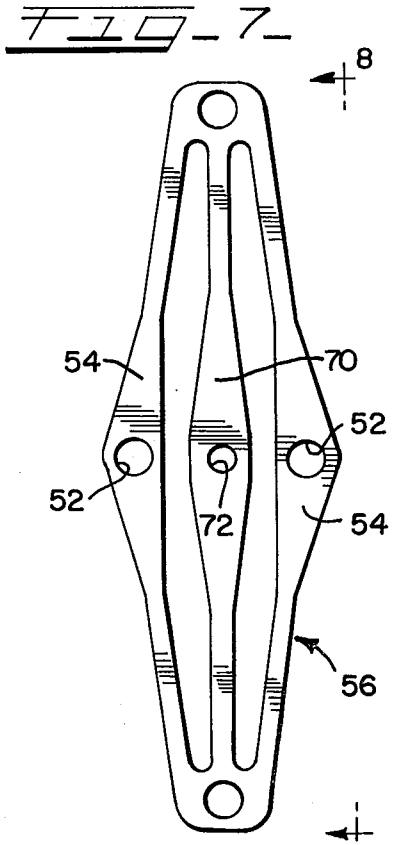
FIG. 7 is a plan view of a spring of the type contemplated for use in the apparatus.

The fasteners 50 extend through openings 52 defined by outer arms 54 of springs 56 of the type shown in FIGS. 7 and 8. Spacers 58 also receive the fasteners 50 with the spacers maintaining a predetermined spaced relationship between respective outer arms of the springs.

The sections 42 of enclosure 28 thus serve as fixtures which secure outer spring arms 54 in place. These sections 42 also define a passage 60 receiving hammer shaft 62. The engaging end 22 of the hammer is fixed at one end of this shaft. The shaft also carries a coil support element 64 and spacers 66 and 68 are mounted on the shaft between engaging end 22 and element 64.

As best shown in FIG. 7, each spring 56 includes a central arm 70, which defines opening 72. The shaft 62 extends through the respective openings 72 as shown in FIG. 6 whereby the spacer 68 serves to hold the central arms a predetermined distance apart. Spacer 66 maintains the relationship between the arms and hammer end 22 with the complete assembly holding the arms fixed relative to shaft 62.

The coil supporting element 64 is held in place by means of nut 74. This element includes radially and rearwardly extending legs 76, and a cylinder 80 is supported on these legs. A coil 82 is wrapped on the cylinder, and each end of the coil has an electrical lead (not shown) connected thereto whereby current can be passed through the coil.

Figure 5:
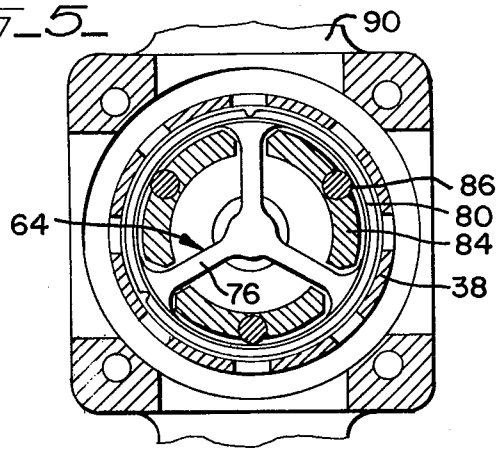
FIG. 5 is a cross-sectional view of the support structure taken about the line 5—5 of FIG. 4.

The cylindrical permanent magnet 92 is magnetized parallel to its axis, and inner magnet segments 84 conduct the flux to the magnetic gap 94. Outer magnetic piece 38 and end cap 34 complete the magnetic circuit. As best shown in FIG. 5, the cylinder 80 and associated coil are adapted to move axially in the magnetic gap between the inner segments 84 and the outer magnetic piece 38. Low friction plastic pins 86 may be provided to insure that the moving cylinder 80 never contacts the inner magnetic segments 84 even under conditions of very high side loads such as may occur with a deformed spoke on the printing disc.

In a well-known fashion, current supplied to coil 82 will result in movement of the coil within the magnetic field. As described in the aforementioned Goin U.S. Pat. No. 3,072,045, the magnitude of a current pulse will determine the driving force imparted to the coil and associated hammer. The polarity of the current pulse will determine the direction of the driving force applied to the hammer. Since the magnitude of a current pulse as well as its direction can be readily controlled, a drive of the type described has distinct advantages. It will be appreciated, however, that the hammer supporting structure is contemplated for use in association with drive means other than the moving coil arrangement illustrated.

Figure 4:
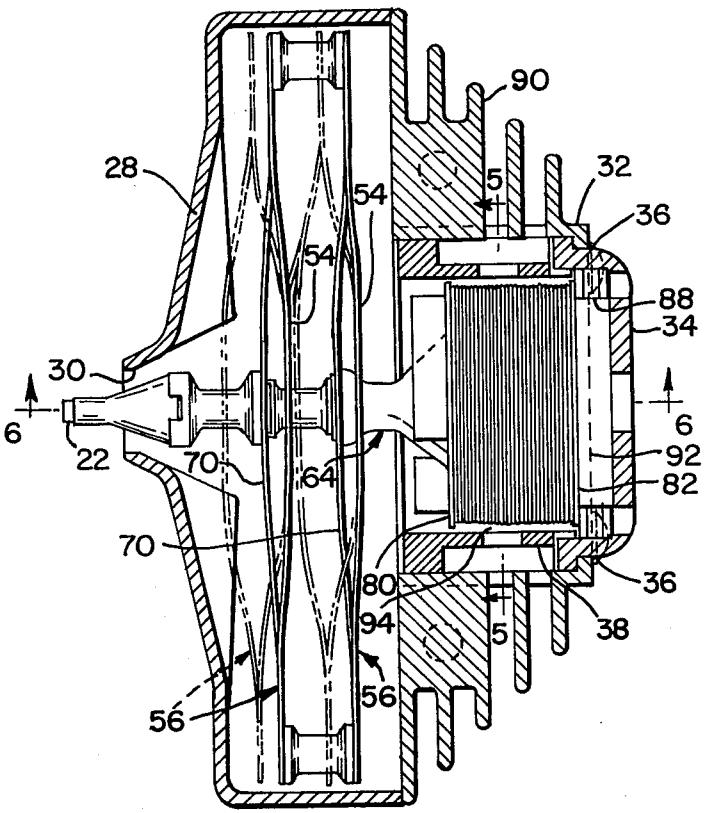
FIG. 4 is a cross-sectional view of the support structure taken about the line 4—4 of FIG. 3.
Figure 3:
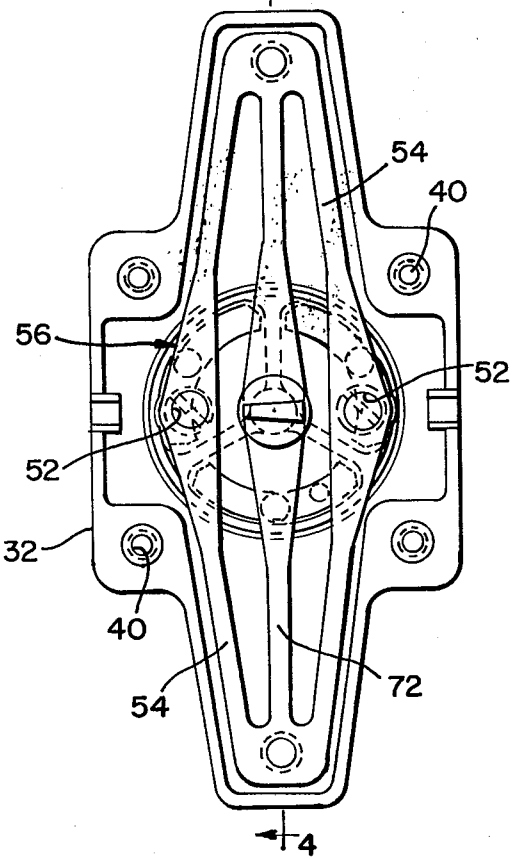
FIG. 3 is an end view of the hammer support structure with an outer housing portion removed.

As best illustrated in FIG. 4, the springs 56 are preferably associated with the hammer in a manner such that the hammer will be biased rearwardly. Thus, it will be noted that the connections of outer arms 54 with the fixture sections 42 are rearward of the solid line positions of central arms 70. As shown in FIG. 8, the free spring 56 is completely flat and, therefore, the central arms 70 will tend to drive the hammer rearwardly. The coil cylinder 80, however, seats on annular ring 88 to prevent rearward movement of the hammer. This biased arrangement insures that the impact stroke of the hammer will always commence from the same position relative to the supporting structure thereby assisting in the control of the hammer operation.

The dotted line positions of the arms 70 and 54 in FIG. 4 illustrate the extent of movement of the hammer in a typical operation. It will be appreciated, however, that the structure described is capable of even greater movement, for example, in a situation where a spoke were broken. This capability of the equipment reduces the likelihood of damage in that event.

In the form of the invention illustrated, the spacers 58 and 68 have the same longitudinal dimensions so that the springs are maintained the same distance apart at all points along their length. It will be appreciated that variations in this arrangement and in other aspects of the spring design are contemplated.

The particular spring design has been found to provide a hammer support arrangement which is highly suitable for controlling the alignment of the hammer during an impact stroke. The use of upper and lower outer arms substantially eliminates any tendency toward movement of the hammer around the axis of shaft 62. The provision of a pair of springs in spaced relationship substantially eliminates tilting of the hammer around any point along its axis. Accordingly, the axis of the shaft is maintained in constant alignment during reciprocation so that the hammer movement is continuously reproducible. As indicated, the spring design is also characterized by an especially long life and, therefore, the arrangement described is not susceptible to maintenance problems or other unreliable operating features recognized in prior art systems.

The utilization of springs of the particular type illustrated has specific advantages since the 3-leaf design, coupled with the deflection when the springs are at rest, results in tripod characteristics. This stabilizes the hammer particularly during shifting movement to further insure maintenance of the hammer in a straight line. As indicated, this provides great reliability from the standpoint of printing quality while also eliminating wear possibilities. In this connection, the coil cylinder is also maintained in a constant path of movement by the spring support so that engagement of the cylinder and associated coil with magnet surfaces is substantially avoided.

The arrangement of the invention has further advantages when compared with the diaphragm structure as described in the aforementioned Goin patent. That type of structure has limited hammer travel possibility when a reasonable size is employed. If a diaphragm of sufficient diameter were utilized, the diaphragm would interfere with viewing of the printing as it is produced. The arrangement of this invention provides completely adequate travel without interfering with the operator's view of the printed characters. This arrangement has the further advantage that it is not rigid so that small irregularities in die surfaces or the like can be accommodated.

The structure of the invention may include heat dissipating ribs 90 extending outwardly from housing portion 32. It is also contemplated that the ring 88 which provides a seat for cylinder 34 when the cylinder is at rest be formed of an energy absorbing material. A wide variety of such materials may be utilized, for example, a hard natural or synthetic rubber. Particularly since the energy of the returning hammer assembly can be electrically dissipated by applying a "braking" pulse to the coil, the use of a resilient ring 88 is optional.

The dimensions of the structure described as well as operating parameters may vary considerably depending upon the particular operation involved. In a typical structure, however, the springs 56 will have a length of about 2½ inches and the hammer excursion when striking a character will be between about 0.15 and 0.16 inches. A typical operating frequency in the automatic mode of such equipment is 60 cycles per second, and it is estimated that the coil and hammer experience accelerations in excess of 150 g's under such circumstances. The fatigue life of the springs, which may be produced from commercial austenitic stainless steel, is well in excess of satisfactory requirements.

The coil structure may comprise a cylinder ¾ inches in diameter and ⅜ inches long with the coil itself comprising 4 layers of 36 gauge copper. In accordance with standard coil design, the layers may comprise two sets of parallel layers in series with each other.

Voltage supplies between 15 and 40 volts are contemplated, and 6 pulse levels may be utilized to accommodate different characters. The following table refers to characters of increasing area and refers to suitable cycle durations in milliseconds as follows:

$t_1$ - voltage applied; hammer accelerated toward platen
$t_2$ - zero voltage; hammer strikes platen toward end of period and begins return movement due to spring force
$t_3$ - reverse voltage applied to accelerate return
$t_4$ - zero voltage; hammer continues return
$t_5$ - positive voltage (braking pulse) applied Time Values For A Typical Coil

| Impact Level | Typical Char. | Time In Milliseconds $t_1$ | $t_2$ | $t_3$ | $t_4$ | $t_5$ | t Total |
|---|---|---|---|---|---|---|---|
| 1 | . | 1.47 | 1.175 | 1.78 | .892 | .136 | 5.45 |
| 2 | — | 1.692 | 1.30 | 1.156 | .760 | .136 | 5.04 |
| 3 | e | 1.96 | 1.39 | .623 | .804 | .136 | 4.91 |
| 4 | L | 2.09 | 1.085 | .223 | 1.425 | .136 | 4.96 |
| 5 | A | 2.18 | 2.77 | 0 | 0 | .136 | 5.09 |
| 6 | M | 2.31 | 2.44 | 0 | 0 | .136 | 4.89 |

As indicated by the table, the higher energy levels are achieved by increasing $t_1$. At these energy levels, it is contemplated that the return pulse ($t_3$) be eliminated since the rebound force is sufficient to maintain the total operating time within the desired range. In this connection, it will be apparent that the total time, t, for each impact level is extremely close so that the over-all equipment operation is not affected by the utilization of the large variety of impact levels.

It will be understood that various changes and modifications may be made in the above described system which provide the characteristics of the invention without departing from the spirit thereof particularly as defined in the following claims.

That which is claimed is:

1. In a printing apparatus including a paper supporting means, a plurality of printing dies, movable support means for the dies operating to selectively locate dies in position adjacent the paper, a reciprocally driven, longitudinally extending hammer having a central axis, said hammer defining means for providing die impressions on the paper, and drive means for the hammer, the improvement comprising a support for said hammer, said support comprising a fixture defining an opening freely receiving the hammer for movement of the hammer within the opening without contact with the fixture, a plurality of spring arm means disposed in spaced, substantially parallel relationship with one another and extending transversely of the fixture, means securing each said arm means to the fixture, and means securing said hammer to an intermediate portion of each said arm means, said spring arm means providing a constant force normally urging said hammer toward a position of rest in said fixture, said drive means selectively providing a drive force for advancing the hammer outwardly along its axis from the rest position, in opposition to the spring force of said arm means, said arm means maintaining a fixed spatial relationship between the axis of the hammer and said fixture, the spring force of said arm means being utilized for providing return movement of the hammer to the rest position when said drive force is removed, and wherein each said arm means includes a central arm defining said intermediate portion and outer arms, said hammer being secured to a central arm of each said arm means, said central arm extending across said opening defined by the fixture, said outer arms of each said arm means being secured to the fixture at locations spaced radially outwardly from said central axis, the central arm and outer arms of each arm means extending to common, opposite outer end positions, and including means attaching the common, opposite outer ends of each arm means to each other, said outer arms comprising a pair of outer arms located on opposite sides of said central arm, and including spacers separating the common, opposite outer ends of the arm means, said common, opposite outer ends being attached to said spacers, and including a shaft supporting said hammer at one end, a spacer supported on the shaft, each central arm defining an opening which receives said shaft, said spacer being positioned between said central arms for thereby holding the central arms in a predetermined spaced relationship, and including a seat located in said fixture, said hammer engaging said seat when in said position of rest, said central arms being normally maintained in positions a greater distance from said seat than said outer arms, operation of said drive means forcing said central arms outwardly a greater distance from said seat.

2. An apparatus in accordance with claim 1 wherein the spacers at the common, opposite outer ends and the spacer on said shaft are of substantially the same length whereby the respective arms of the arm means are held substantially the same distance apart.

3. An apparatus in accordance with claim 1 wherein said outer arms define intermediate openings, and fasteners extending through said intermediate openings for securing the outer arms to said fixture.

4. An apparatus in accordance with claim 1 wherein said drive means includes a moving coil attached to said shaft at the end opposite said hammer, and said fixture including magnetic means defining a magnetic field, wherein there is further included means for supplying current to the coil, whereby said coil is movable within said magnetic field for thereby moving the hammer.

5. An apparatus in accordance with claim 4 including means for supplying said current to the coil with opposite polarities, movement of the coil in one direction thereby providing for driving of the hammer to achieve an impression, and movement of the coil in the other direction supplementing said spring force during return movement of the hammer.

6. An apparatus in accordance with claim 1 wherein said support means for the dies comprise a rotatably mounted disc, said dies being positioned at the ends of spokes on said disc.

* * * * *